US005762377A

United States Patent [19]

Chamberlain

[11] Patent Number: 5,762,377

[45] Date of Patent: Jun. 9, 1998

[54] METHOD OF AUTHENTICATING AN ITEM AND AN APPARATUS FOR AUTHENTICATING AN ITEM

[75] Inventor: John R. B. Chamberlain, Boca Raton, Fla.

[73] Assignee: Esselte Meto International GmbH, Heppenheim, Germany

[21] Appl. No.: 692,173

[22] Filed: Aug. 5, 1996

Related U.S. Application Data

[63] Continuation-in-part of Ser. No. 409,135, Mar. 23, 1995, abandoned.

[51] Int. Cl.[6] ..... B42D 15/00

[52] U.S. Cl. ..... 283/67; 283/81; 283/94; 283/101

[58] Field of Search ..... 283/67, 70, 72, 283/81, 86, 94, 101; 40/299, 630, 310

[56] References Cited

U.S. PATENT DOCUMENTS

| | | | |
|---|---|---|---|
| 3,552,853 | 1/1971 | Sanders et al. | 283/86 X |
| 4,119,361 | 10/1978 | Greenaway . | |
| 4,581,524 | 4/1986 | Hoekman et al. . | |
| 4,971,646 | 11/1990 | Schell et al. | 283/86 X |
| 5,020,831 | 6/1991 | Benardelli . | |
| 5,241,299 | 8/1993 | Appalucci et al. . | |
| 5,267,756 | 12/1993 | Molee et al. . | |
| 5,406,264 | 4/1995 | Plonsky et al. . | |
| 5,421,618 | 6/1995 | Okazaki et al. . | |
| 5,634,669 | 6/1997 | Colgate, Jr. | 283/86 X |

FOREIGN PATENT DOCUMENTS

| | | |
|---|---|---|
| 0295028 | 12/1988 | European Pat. Off. . |
| 0585076 | 3/1994 | European Pat. Off. . |
| 2931932 | 2/1981 | Germany . |
| 8428610 | 1/1985 | Germany . |
| 3419785 | 5/1985 | Germany . |
| 9306671 | 8/1993 | Germany . |
| 9209229 | 1/1994 | Germany . |
| 4226654 | 2/1994 | Germany . |
| 4230548 | 3/1994 | Germany . |
| 0483685 | 2/1970 | Switzerland . |

OTHER PUBLICATIONS

Unsichtbare Artikelsicherung "Super Strip" universell einsetzbar, Verpackungs–Rundschau, 1993.

*Primary Examiner*—Willmon Fridie, Jr.
*Attorney, Agent, or Firm*—Thomas N. Ljungman

[57] ABSTRACT

A method of authenticating an item and an apparatus for authenticating an item. The items which can be authenticated are typically located in a sales room or other commercial establishment where goods are typically sold. There has been an increasing trend wherein manufacturers are providing items typically on display in sales showrooms with a tag or marking which can serve to authenticate the item or product. The consumer can then determine if the item is genuine or counterfeit by means of the tag or other identifying marking.

20 Claims, 7 Drawing Sheets

METHOD OF AUTHENTICATING AN ITEM AND AN APPARATUS FOR AUTHENTICATING AN ITEM

This application is a Continuation-in-Part application from U.S. patent application Ser. No. 08/409,135, which patent application was filed on Mar. 23, 1995, with the inventor John R. B. Chamberlain, and has since been abandoned, and which application claimed priority from Federal Republic of Germany Patent Application No. P 44 10 137.6, filed on Mar. 24, 1994, with the inventor John R. B. Chamberlain.

BACKGROUND OF THE INVENTION

1. Field of the Invention:

The present invention can generally relate to a method of authenticating an item and an apparatus for authenticating an item. The items which can be authenticated in accordance with the present invention are typically located in a sales room or other commercial establishment where goods are typically sold.

2. Background Information:

There has been an increasing trend wherein manufacturers are providing items typically on display in sales showrooms with a tag or marking which can serve to authenticate the item or product. The consumer can then determine if the item is genuine or counterfeit by means of the tag or other identifying marking.

As stated above, valuable items are increasingly being provided with proofs of authenticity, e.g. holograms for example, as proof of their authenticity, to make it easier for customers to recognize imitations and counterfeits. Any non-genuine products can frequently be disqualified or recognized on the basis of defective quality (e.g. cheap film packaged to look like well-known quality film). These counterfeit or non-genuine products may also even be hazardous, such as counterfeit brake linings for motor vehicles. As such, there can be disadvantages for the buyer, as well as for the retailer, the wholesaler and the manufacturer.

In addition, customers who unknowingly purchased a counterfeit product, and are thus dissatisfied, frequently make claims against the retailer, the wholesaler or the manufacturer of the genuine products, since the customer thought the latter was the actual manufacturer. In court cases, or in a courtroom setting, it is frequently difficult for the manufacturer who has been sued to prove that it did not manufacture the products which are the subject of the complaint. Since such problems can essentially be eliminated by labelling the item with proofs of authenticity, an increasing number of items are being certified in this manner.

OBJECT OF THE INVENTION

An object of the present invention is to create protection for items by authenticating the items, which protection can be characterized by increased security.

SUMMARY OF THE INVENTION

The present invention teaches that this object can achieved by attaching the proof of authenticity in an essentially non-removable manner to the item to be protected, whereby the proof of authenticity should be very difficult to imitate or counterfeit. There can be a substantial benefit for the manufacturer due to the increased protection that this authentication can provide against counterfeiting of the merchandise. Reduced counterfeiting can be advantageous for all parties involved, i.e. the customer, the manufacturer, the wholesaler and the retailer, since the risk of problems which can result from the poor quality of counterfeit products, or the recourse which may be taken due to such counterfeit products, is typically reduced.

Items labelled and authenticated in accordance with the present invention will generally enjoy high acceptance among consumers, retailers and manufacturers, due to the advantages mentioned above, and will therefore enjoy a significant market advantage.

In accordance with the present invention, the type of proof of authenticity can be essentially anything which is appropriate. For example, the proof of authenticity can be a hologram, which holograms are well known in the art. In addition, also available commercially is a transparent material provided with cylindrical lenses on the surface running parallel to one another, whereby for each cylindrical lens there is at least one colored line running parallel to the axis of the cylindrical lens in the interior of the material. Such proofs of authenticity are characterized by a relatively high degree of protection against counterfeiting, and are also very economical.

If the present invention is used to protect and prove the authenticity of a compact disc (CD), the proof of authenticity can preferably be applied in a ring-shaped manner around the central opening on the upper side of the CD, to prevent any imbalance which may interfere with playing the CD.

The present invention can also be used on other objects, in addition to compact discs. For example, the present invention can be used on packaging materials (e.g. for foods), on bottles, on electrical and electronic appliances, garden equipment, audio tape cassettes, video tape cassettes, diskettes, envelopes for diskettes, video or audio tapes, on office equipment, optical equipment, furniture, books or cosmetics, etc.

On bottles or food packaging, the proof of authenticity can, in addition to proving the authenticity of the item, also perform an additional function. If the proof of authenticity is applied to the opening of the package, for example as a tamper strip, it can be possible to see whether the seal has already been broken or the package opened or tampered with. A customer can then visually detect a package or bottle which has already been opened and can decide not to buy it.

Finally, it is also conceivable that textiles can be provided with a proof of authenticity. In this situation, the proof of authenticity is generally also made of textile material, for example in the form of an emblem or logo, and the proof of authenticity can be fastened to the item of clothing preferably by means of an adhesive connection.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

One aspect of the invention resides broadly in a method of authenticating an item with a tag, the tag comprising: means for proving authenticity of the item, the means for proving authenticity having a first side and a second side; the first side of the means for proving authenticity being disposed to face the surface of the item; the second side of the means for proving authenticity facing away from the first side; means for being sensed, the means for being sensed being disposed between the first surface of the means for proving authenticity and the surface of the item; and means for non-detachably fastening the proof of authenticity to the means for being sensed such that the proof of authenticity can be removed from the means for being sensed substantially only upon destruction of the means for proving authenticity, the method comprising the steps of: providing means for proving authenticity of the item, the means for proving authenticity having a first side and a second side; the first side of the means for proving authenticity being disposed to face the surface of the item; the second side of the means for proving authenticity facing away from the first side; providing means for being sensed, the means for being sensed being disposed between the first surface of the means for proving authenticity and the surface of the item; and providing means for non-detachably fastening the proof of authenticity to the means for being sensed; the method further comprising the steps of: non-detachably fastening the proof of authenticity to the means for being sensed; and fastening the tag to the item to be authenticated.

Another aspect of the invention resides broadly in a tag for authenticating an item, the item having a outwardly directed surface thereon, the tag comprising: means for proving authenticity of the item, the means for proving authenticity having a first side and a second side; the first side of the means for proving authenticity being disposed to face the surface of the item; the second side of the means for proving authenticity facing away from the first side; means for being sensed, the means for being sensed being disposed between the first surface of the means for proving authenticity and the surface of the item; and means for non-detachably fastening the proof of authenticity to the means for being sensed such that the proof of authenticity can be removed from the means for being sensed substantially only upon destruction of at least the means for proving authenticity.

Another aspect of the invention resides broadly in that the proof of authenticity is a hologram.

Yet another aspect of the invention resides broadly in that the proof of authenticity is a transparent material provided on the surface with cylindrical lenses running parallel to one another, whereby for each cylindrical lens there is at least one colored line in the interior of the material running parallel to the axis of the cylindrical lens.

Still another aspect of the invention resides broadly in that the means for being sensed is fixed by means of an adhesive connection to the proof of authenticity and/or to the item.

Another aspect of the invention resides broadly in that the means for being sensed is positioned on a self-adhesive backing film, the adhesive side of which is preferably in contact with the item.

Yet another aspect of the invention resides broadly in that the surface of the proof of authenticity facing the item is provided with a self-adhesive coating.

Another aspect of the invention resides broadly in that the item to be authenticated is a compact disc, around the central opening of which the proof of authenticity and the means for being sensed are placed in an encircling, ring-shaped manner.

BRIEF DESCRIPTION OF THE DRAWINGS

Embodiments of the present invention are explained in detail below and are illustrated in the accompanying drawings, in which.

DESCRIPTION OF THE PREFERRED EMBODIMENT

Figure 1:
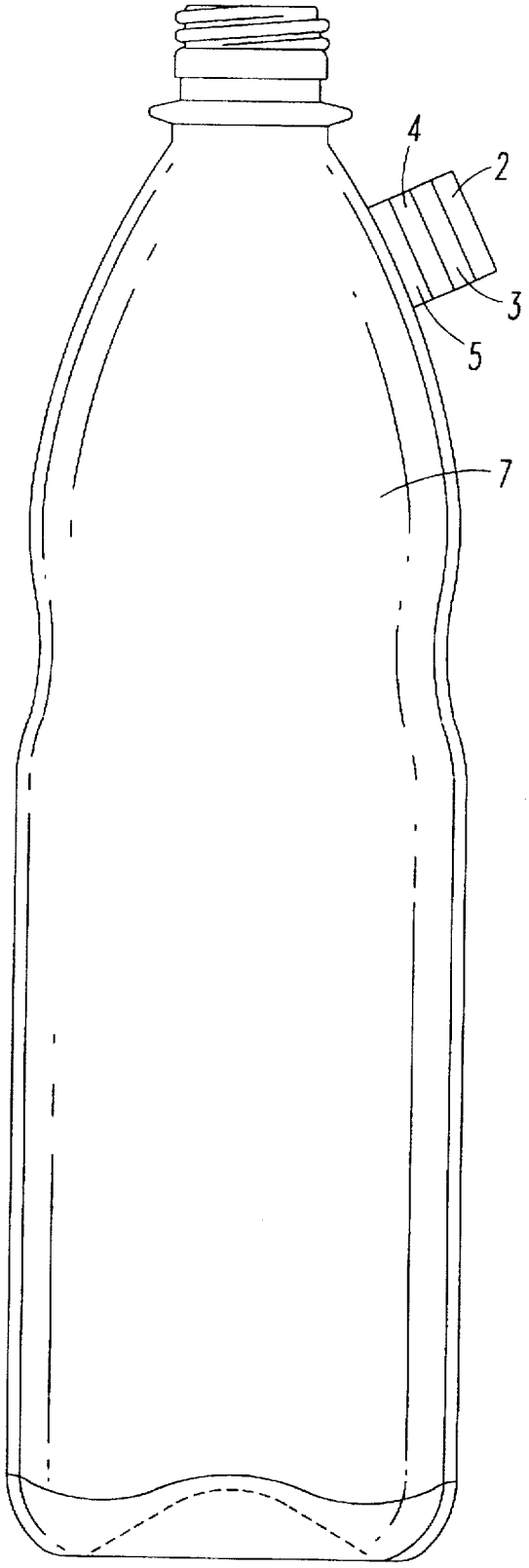
FIG. 1 shows a bottle incorporating the present invention to authenticate the bottle.
Figure 1A:
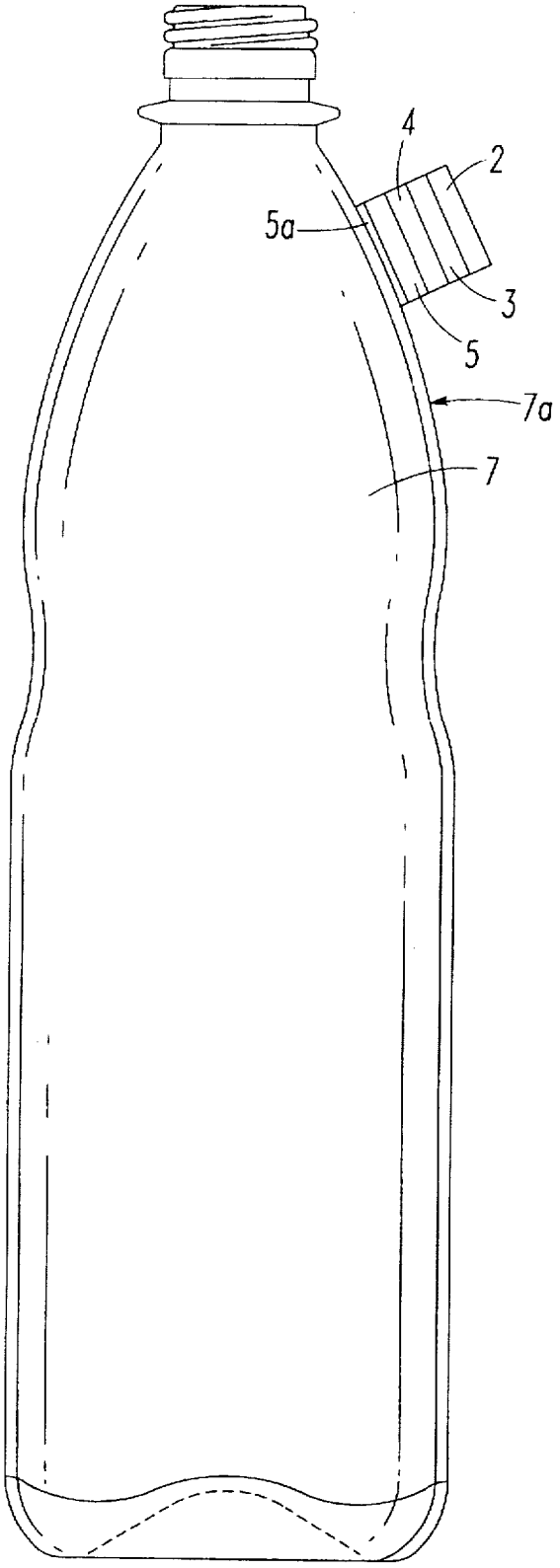
FIG. 1*a* shows substantially the same view as FIG. 1, but shows additional components.

FIGS. 1 and 1*a* show a bottle 7 which can preferably include a proof of authenticity 2, in accordance with the present invention. The layer structure shown in FIGS. 1 and 1*a* (discussed further below) can preferably be placed essentially immediately below the neck of the bottle 7, in accordance with one embodiment of the present invention.

Figure 2:
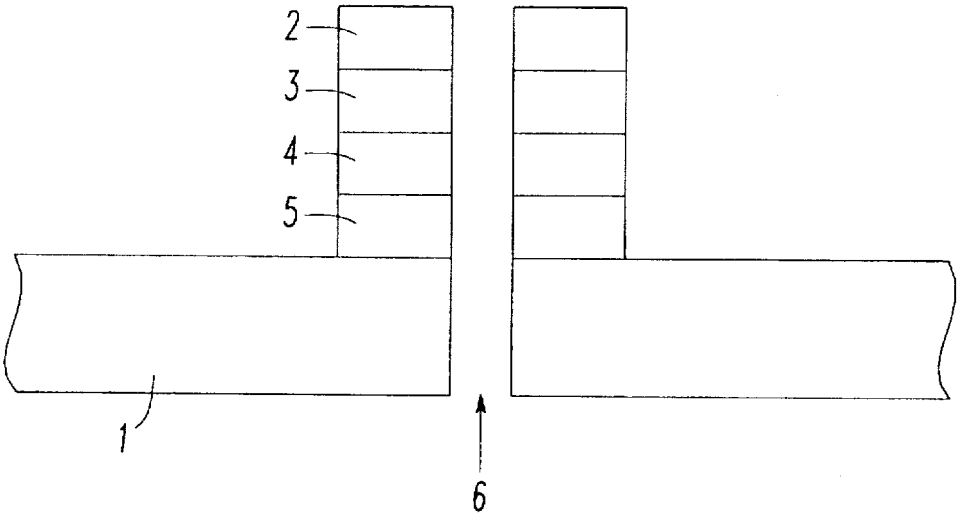
FIG. 2 shows a compact disc incorporating the present invention.
Figure 2A:
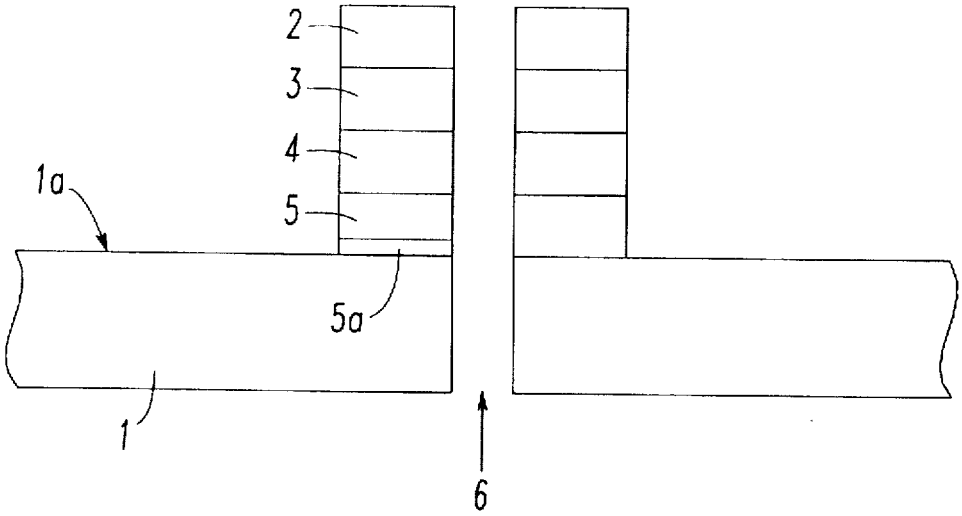
FIG. 2*a* shows substantially the same view as FIG. 2, but shows additional components.

FIGS. 2 and 2*a* show an enlarged view of a compact disc 1 in cross section. For authenticating the compact disc 1 a proof of authenticity 2 can preferably be attached to the compact disc 1. The proof of authenticity structure or tag can include several layers located in a ring-like manner around a central opening 6 of the compact disc 1.

Referring back to FIGS. 1 and 1*a*, the bottle 7 shown there can preferably include the combination of a security element 4 and the proof of authenticity 2, in accordance with the present invention. The layer structure shown in FIGS. 1 and 1*a* (discussed in detail further below) can preferably be placed essentially immediately below the neck of the bottle 7, in accordance with one embodiment of the present invention. There can be a self-adhesive backing film 5 between a wall 7*a* (see FIG. 1*a*) of the bottle 7 and the security element 4. As shown in FIG. 1*a* and in accordance with one embodiment, the backing film 5 can preferably have an adhesive coating 5*a* (see FIG. 1*a*) for attaching the security element 4 to the bottle 7. A self-adhesive coating 3 on the proof of authenticity 2 can preferably non-removably secure the proof of authenticity 2 to the security element 4. It is generally known to provide bottles with a ribbon seal, or possibly a revenue stamp which acts as a seal, so that an opening of the bottle will cause the seal to be broken, or at least detached from the bottle. If the bottle 7 is provided with such a ribbon seal or revenue stamp, a portion of the security element 4 can also be in contact with said ribbon seal, so that the buyer will easily be able to detect any breaking of the seal by the damage which such an opening will have caused to the proof of authenticity 2.

One example of such a seal with which the present invention may be utilized is disclosed in U.S. Pat. No. 5,174,851, which issued to Zodrow et al. on Dec. 29, 1992. In accordance with the labelling mechanism and the method of applying these types of labels/seals to bottles in U.S. Pat.

No. 5,174,851, the security element 4 of the present invention could conceivably be placed under the label/seal shown in FIG. 1 of U.S. Pat. No. 5,174, 851, and can then be attached to the bottle along with the label/seal.

Referring back to FIGS. 2 and 2*a*, which show an enlarged view of a compact disc 1 in cross section, for protecting the compact disc 1 against theft, a combined security element and proof of authenticity can preferably be attached to the compact disc 1. The security element/proof of authenticity combination can include several layers located in a ring-like manner around a central opening 6 of the compact disc 1. A security element 4 can preferably provide protection against shoplifters, and in the illustrated example, the security element 4 can preferably be a magnetically soft, thin film deposited on a backing film 5. The backing film 5 can preferably be provided on its underside with a self-adhesive coating 5*a* (see FIG. 2*a*), which adhesive coating 5*a* can preferably be in contact with a surface 1*a* (see FIG. 2*a*) of the compact disc 1. A proof of authenticity 2, for example a hologram, can preferably be attached to the security element 4. The proof of authenticity can preferably be provided on its underside with a self-adhesive coating 3, by means of which coating 3 the proof of authenticity 2 can be attached to the security element 4, so that the security element 4 essentially cannot be removed from the compact disc 1. In accordance with at least one embodiment of the present invention, the proof of authenticity can essentially cover the security element 4, thus making detection of the security element 4 essentially impossible.

In accordance with one embodiment of the present invention, the combination of the proof of authenticity 2 and the security element 4 could preferably be incorporated into the item itself, for example food items in particular. Thus, the proof of authenticity 2 and the security element 4 can essentially be permanent components of the packaging of the item and could therefore be disposed of along with the packaging, after the item has been consumed.

Figure 3:
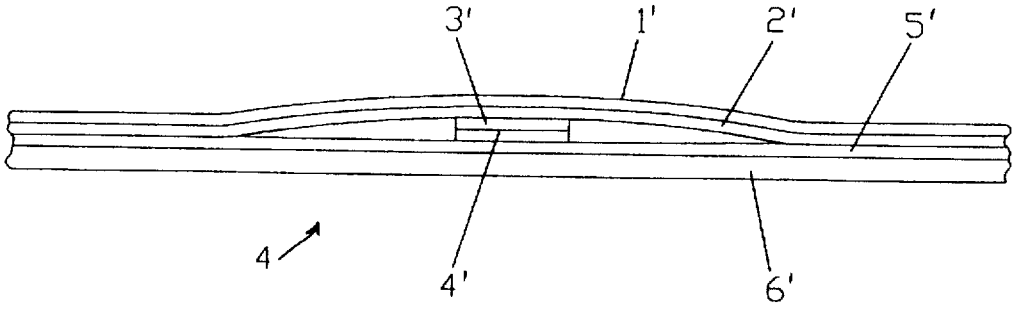
FIG. 3 shows, in cross section, a tag.

FIG. 3 shows one possible type of security element 4 which could be used in accordance with the present invention. It should be understood that the various components discussed herebelow may be considered to be interchangeable with similar components discussed hereinabove with regard to FIGS. 1–2*a*. The security element 4 can, in accordance with one embodiment, be in the form of a tag, or anti-theft tag. As shown in FIG. 3, the anti-theft tag can preferably have a backing film 2' for a continuous, magnetically soft metal strip 4', and a recording medium 6' glued to the metal strip 4'. So that the anti-theft tag is not recognizable as such and looks like a conventional paper tag, the recording medium 6' can be provided with a low-transparency coating 5' on the side facing the metal strip 4'. It should be generally understood that such a coating 5' could be used for essentially any type of tag which is meant to cover over, or conceal, something, i.e., even an old price tag, for example. It should be noted, however, that since the proof of authenticity 2 can preferably be affixed to the security element 4 and can essentially cover the security element 4 in accordance with the present invention, the coating 5' may essentially not be necessary, unless the proof of authenticity 2 wouldn't cover the entire security element 4. Further, it should additionally be noted that the proof of authenticity 2 can preferably replace the recording medium 6' in the embodiments illustrated in FIGS. 3–8*b*.

The tag illustrated in cross section in FIG. 3 is depicted with a backing strip 1' which could possibly be made of conventional paper, such as paper having a weight of 67 g/m$^2$, but other materials, such as plastics, etc, could also be used. This backing strip 1' can preferably be coated with silicone on the side facing the other layers of the tag. It is generally known that silicone has the characteristic of relatively low adhesion to adhesives. In essence, other materials having low adhesion to adhesives could also be used as the coating for the strip 1'.

According to at least one of the embodiment of the present invention, this low adhesion of the backing strip 1' preferably enables the backing strip 1' to be easily removed from the backing film 2', which backing film 2' can be an essentially permanent part of the tag. This backing film 2' can preferably be coated on both sides with an adhesive. Thus, in accordance with one embodiment, the side of the backing film 2' which faces the backing strip 1' can preferably be attached to the item to be protected after the backing strip 1' has been removed from the backing film 2'. In one embodiment, such as possibly the embodiment illustrated in FIG. 3, the backing film 2' can preferably be in the form of a transparent polyester film and can be coated with aluminum (which can preferably be applied by metallizing or sputtering) on the side facing the actual security element, i.e., the metal strip 4'.

In accordance with one embodiment, and as mentioned above, the coating 5' and the recording medium 6' can preferably be eliminated since the proof of authenticity 2 can essentially replace the recording medium 6' and will essentially cover the security element 4'.

In one possible mode of manufacture of the anti-theft tag, the backing film 2' can first be adhered onto the backing strip 1'. The backing film 2' could then receive a coat of adhesive on the other side thereof. Then pieces 3' of magnetically hard metal can be adhered onto the other side of the backing film 2', at preferably substantially equal intervals from one another and preferably in a row. Over the metal pieces 3', a continuous, magnetically soft metal strip 4' can be fixed to the backing film 2' by the adhesive action of the adhesive located in the spaces between the pieces of metal 3'. Such an arrangement of the pieces of metal 3' and of the metal strip 4' is shown particularly clearly in FIG. 4.

By means of the adhesive located on the underside of the backing film 2', the backing film 2' can then be glued to a recording medium 6'. This recording medium 6' can be a temperature-sensitive paper, or alternately a conventional paper, which, in accordance with the present invention, can have a low-transparency coating 5' on the side thereof facing the backing film 2'. In one embodiment of the invention, such as the tag illustrated in FIG. 4, the coating 5' could preferably be a grey, opaque layer of ink or paint. However, this coating 5' may be unnecessary as discussed above, since the proof of authenticity 2 can preferably be attached to the security element 4' so that the security element 4' essentially cannot be detected.

Figure 4:
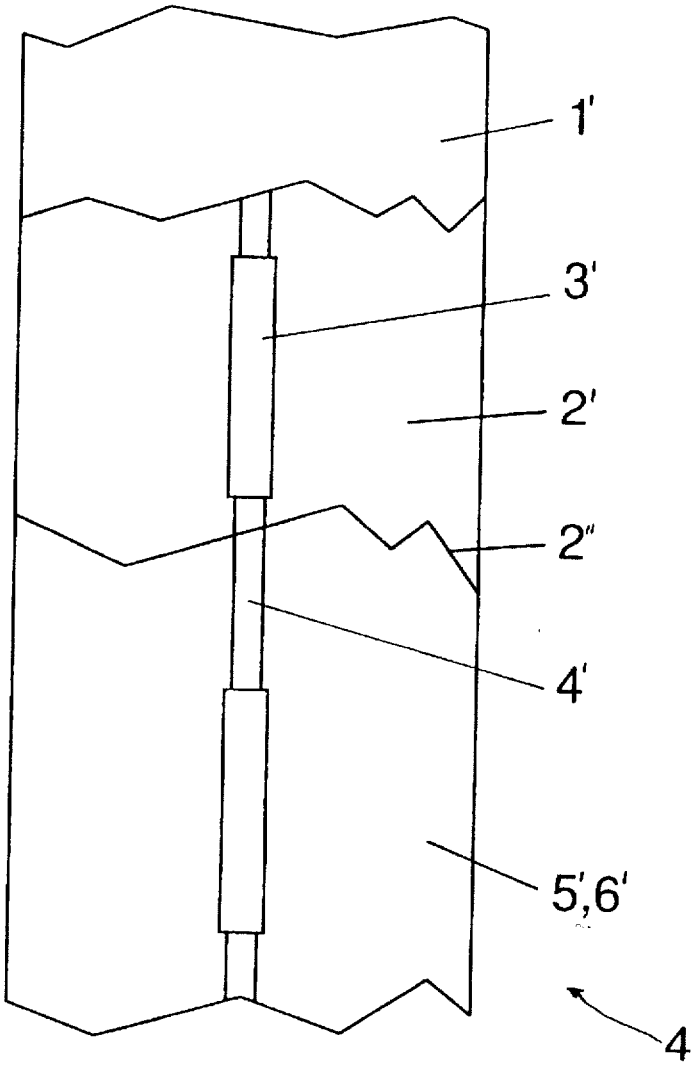
FIG. 4 shows a plan view, in partial cross section, of the tag of FIG. 3.

FIG. 4 is a plan view in partial cross section, which shows the individual layers of one embodiment of an anti-theft tag which could be utilized in accordance with the present invention. FIG. 4 shows the backing strip 1', the magnetically hard pieces of metal 3' located at intervals from one another, the magnetically soft metal strip 4' located underneath them, and the recording medium 6' coated with a coat of ink 5'. The backing film 2', which can preferably be transparent polyester and is located between the pieces of metal 3' and the backing strip 1', is indicated only by means of a broken line 2".

Figure 5A:
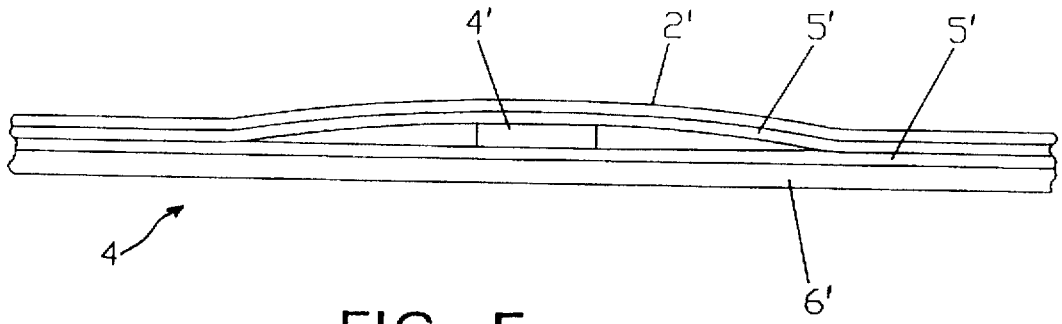
FIGS. 5*a* and 5*b* show simplified tag structures.

As shown in FIG. 5*a*, simpler tags are conceivable for certain purposes, i.e. tags which may possibly only have a backing film 2', a metal strip 4' and a recording medium 6' glued to the backing film 2' or metal strip 4', which recording medium 6' can preferably have the low-transparency coating 5' on the side facing the metal strip 4'. As also shown in this embodiment, the backing film 2' can also possibly have a low-transparency coating 5' disposed thereon, thereby making the tag opaque from both sides possibly for use on transparent objects. As mentioned above, however, the recording medium 6' and the coating 5' can essentially be eliminated since the proof of authenticity 2 can preferably replace the recording medium 6' and can essentially cover the security element 4'.

Figure 5B:
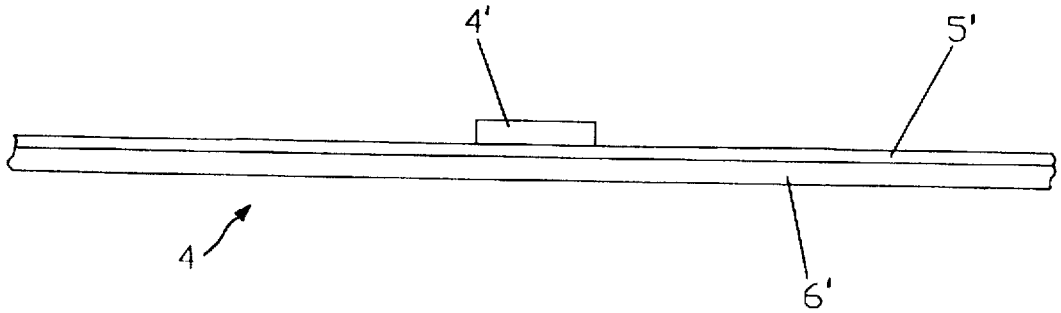

Alternately, as shown in FIG. 5*b*, an even simpler embodiment could be conceivable, wherein there is only a recording medium 6' with a surface coated with adhesive, to which surface is adhered a metal strip 4'. The surface, before being coated with adhesive, could preferably be coated with the low-transparency coating 5', if necessary. In addition, the recording medium 6' can preferably have an additional layer of adhesive on the side facing away from the metal strip 4', in order to attach the security element 4' to the item to be protected. Alternatively, the embodiments of FIGS. 5*a* and 5*b* could also be provided with a backing strip 1' to simplify handling and transport, etc.

In essence, it is also conceivable that other types of security elements, other than a soft magnetic material 4' can be used with such a label configuration in accordance with the present invention. For example, while the recording medium 6' can be transparent to visible light, and the coating 5' can be opaque to visible light, it could be conceivable that a coating 5' can be provided which coating 5', in conjunction with the recording medium 6', are both transparent to a non-visible radiation, which might be ultra-violet radiation, infra-red radiation, etc. A security element 4 could then possibly be configured which is able to reflect such radiation back to a receiver to trigger an alarm, or possibly react in some other manner to the penetrating radiation and thereby trigger an alarm. In such instances, since the layer 5' is opaque to visible light, the security element 4 would still remain essentially visibly undetectable, if needed.

Figure 8B:
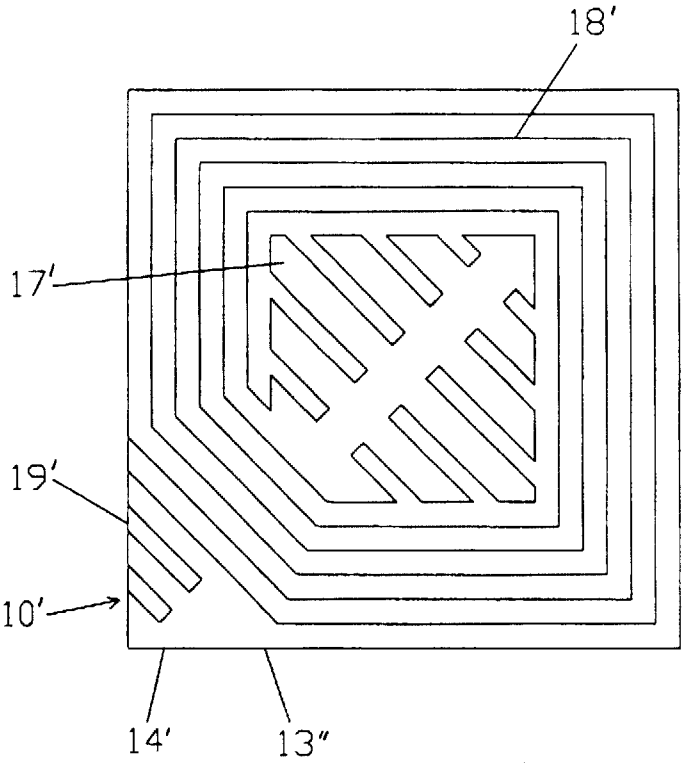
FIGS. 8*a* and 8*b* show plan views of additional tags.
Figure 8A:
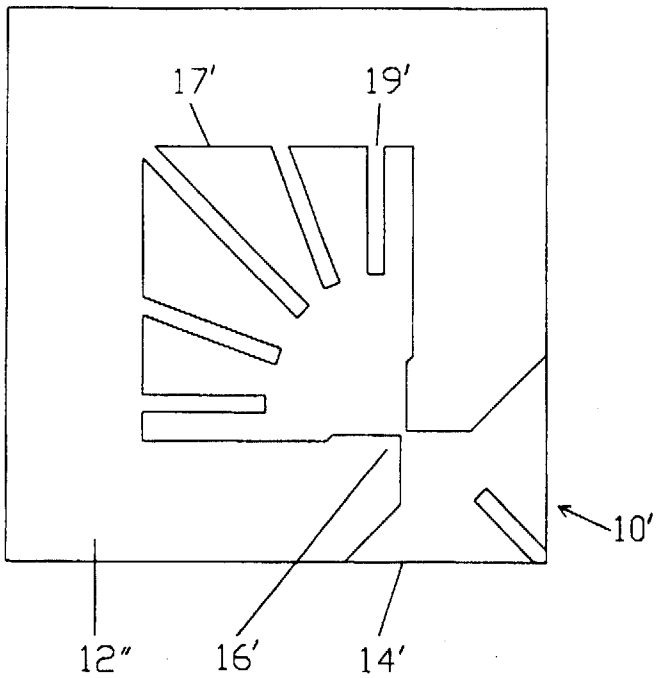

One other type of security element 4 which could be used is what is commonly known as a resonant circuit. FIGS. 8*a* and 8*b* show a typical resonance structure 10' which can possibly be used in accordance with one additional embodiment of the present invention, with FIG. 8*a* showing one side of the tag, and FIG. 8*b* showing the other side. As shown in FIG. 8*a*, an etched pattern 12" is shown on a metallised side of the tag, and as shown in FIG. 8*b*, an etched pattern 13" is shown on the opposite (bulk metal) side of the tag. The tag, or label, can typically be about 40 mm square. The area 14' preferably constitutes an external capacitor, and a fusible link 16' is defined by an etched pattern on the metallised side of the tag. The fusible link 16' connects the external capacitor 14' with the areas 17' which preferably constitute an internal capacitor. The metallised areas 18' preferably constitute a coil. Slits 19' can be present in the positions indicated in order to reduce eddy current losses in the capacitor plates, which can typically be about 0.2 mm thick. In general, the slits of opposing capacitor plates preferably cross approximately at right angles, thereby minimizing capacitance errors. In general, such circuits are well known, and are therefore not discussed in any further detail herein.

Figure 6:
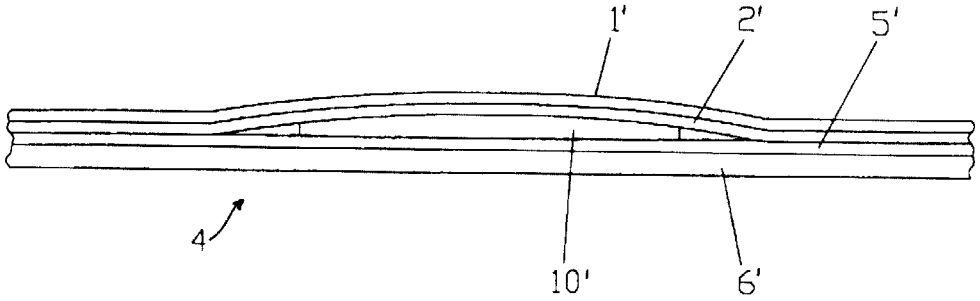
FIG. 6 shows, in cross section, a tag including the structures shown in FIGS. 8*a* and 8*b*.

FIG. 6 shows the resonance structure 10' of FIGS. 8*a* and 8*b* incorporated into a label structure in accordance with one embodiment of the present invention. As depicted, one possible embodiment of a label structure could have the resonance structure 10' replacing the magnetic materials 3' and 4'. The printing medium 6' can be coated on the resonance structure side of the label with the coating 5', to thereby make the resonance structure 10' essentially unable to be seen through the printing medium 6'. However, as discussed above, the coating 5' and the recording medium 6' can essentially be eliminated since the proof of authenticity 2 can preferably replace the recording medium 6' and can essentially cover the security element 4.

Figure 7:
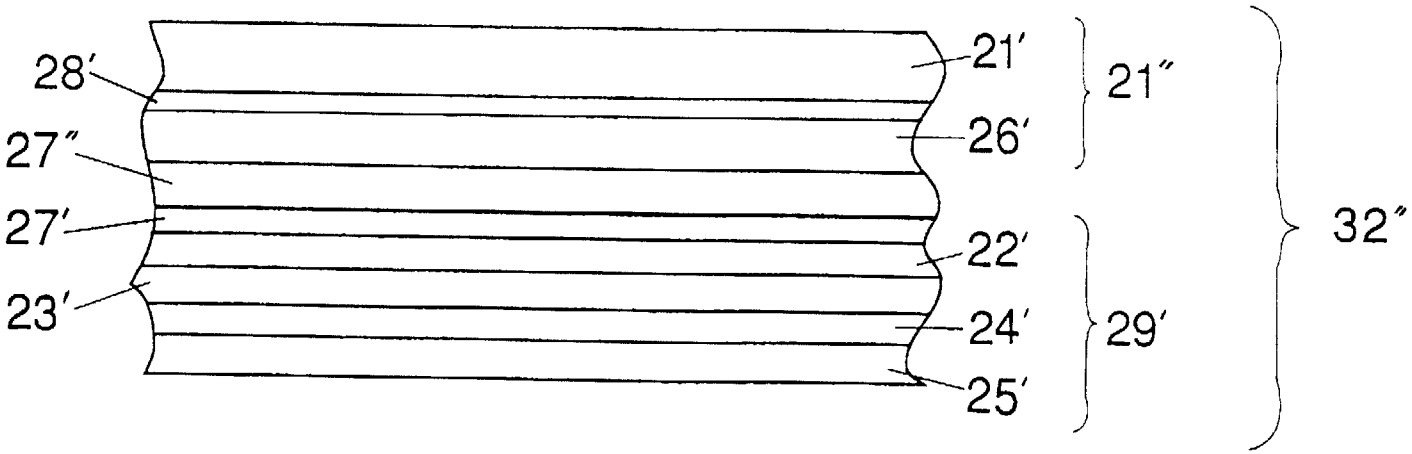
FIG. 7 is an additional embodiment of a tag.

FIG. 7 illustrates an additional embodiment of an anti-theft tag having a layer of magnetic material as the security element. FIG. 7 shows a tag, in cross section, which preferably has a printable recording medium 21'. It should be understood that the recording medium 21' can preferably be replaced by the proof of authenticity 2, in accordance with at least one embodiment, since the proof of authenticity 2 can essentially cover the security element. This printable recording medium 21' can be conventional label paper, which can be printed upon by means of an inked printing plate. Alternatively, this medium 21' could also be a temperature-sensitive thermal label paper which can be printed upon by means of a thermal printer head. The recording medium 21' can also be made of film, such as a mechanically-printed plastic, for which purpose, polypropylene has been found to be particularly well-suited.

This printable recording medium 21' can preferably be coated on its underside, or side disposed towards the rest of the layers of the label, with a low-transparency coating 28', if desired. It should be understood that the coating 28' can preferably be eliminated, in accordance with one embodiment, since the proof of authenticity 2 can preferably cover the security element. Adjacent the coating 28', at least a strip of nickel 26' can preferably be applied. On top of the nickel film 26' there can preferably be a polyester film 27", along with at least a strip of a sputtered, thin layer 27' of a soft magnetic material.

By means of an adhesive 22', preferably designed as a bonding emulsion with a strong adhesive force, the recording medium 21', with metal layers 26' and 27', can preferably be applied to an intermediate layer 23'. This intermediate layer 23' can preferably be of a material which exerts a strong adhesive action on bonding emulsions. The intermediate layer 23', on the other side thereof, can preferably be glued to a carrier sheet, or foil 25' by means of a second adhesive 24', also preferably designed as a bonding emulsion, but with a relatively low adhesive strength.

As mentioned above, it is preferable that the intermediate layer 23' be made of a material which has a strong adhesion to the bonding emulsions. In this regard, the intermediate layer 23' can preferably be made from one of, or even a combination of, the following materials: glassine paper, high-gloss paper, polyethylene film or aluminum foil. Such materials, when used as the intermediate layer, generally exert a strong adhesive force on bonding emulsions.

The carrier sheet, or foil 25', which can preferably be a throw-away backing material to allow for transport and storage of the labels, is preferably coated, at least on the side facing the recording medium 21', with silicone. The silicone essentially exerts a weak adhesive force on bonding emulsions, thereby preferably enabling the carrier foil 25' to be easily pulled away from the intermediate layer 23'. After removal of the carrier foil 25', the label can be attached to the products to be labelled by means of the exposed adhesive layer 24'. In addition, the recording medium 21' can preferably be provided with an adhesive layer on the side facing away from the carrier foil 25' for attachment of the proof of authenticity 2, or alternatively, the proof of authenticity 2 can preferably have its own adhesive layer 3, as discussed hereinabove.

In an alternative embodiment, the carrier foil 25' can preferably be coated on both sides with silicone. By coating the carrier foil 25' on both surfaces with silicone, the manufacturer of labels according to the present invention can produce a primary laminated material, which can preferably serve as the base material for receiving a variety of printable materials thereon. To produce such an intermediate product, the intermediate layer 23' coated with adhesives 22' and 24' on opposite sides thereof, can preferably be deposited onto the carrier foil 25', which carrier foil 25' has preferably been treated with silicone on both surfaces thereof, with the adhesive 24' adjacent the carrier foil 25'. The carrier foil 25' and intermediate layer 23' disposed thereon can then be rolled up into a roll, wherein the adhesive layer 22' will be brought into contact with the side of the carrier foil 25' facing away from the intermediate layer 23'. Since the silicone layer, also located on the side of the carrier foil 25' facing away from the intermediate layer 23', preferably exerts a minimal adhesive action on the adhesive 22', the carrier foil 25' does not adhere to the intermediate layer 23' by means of the adhesive 22', and this intermediate product, or primary laminated material (having layers 22', 23', 24' and 25') can preferably be unrolled for attaching a printable medium 21', with an appropriate security element thereto.

In this manner, the manufacturer can produce a supply of intermediate product which can then be kept in stock. A consumer, after deciding what type of label material would be best suited for a desired purpose and what type of security element 4 is preferred, could then have the manufacturer attach a suitable printing medium 21', with appropriate security layers 26', 27' to the intermediate product to form a finished label. Alternatively, the consumer might also be able to purchase machinery for attaching a printing medium 21' and appropriate security elements 26', 27' to the intermediate product, to thereby make their own customized labels at the consumers end.

Before the label, having components 21' through 28' according to at least one embodiment of the present invention can be applied to a product, the carrier foil 25' can preferably be pulled away by virtue of the silicone on the carrier foil 25'. If the label applied to the product is then to be removed from the product, since the intermediate layer 23' exerts a much stronger adhesive force on the adhesive 24' than the product exerts on the adhesive 24', essentially all of the adhesive 24' will remain adhering to the intermediate layer 23', and substantially no adhesive residue will be left on the product. Under the best conditions, essentially all of the adhesive will remain adhering to the intermediate layer 23', and no adhesive will remain on the product. In spite of the minimal adhesive force between sputtered layers and adhesive, the intermediate layer 23' can preferably remain adhering to the sputtered layer 27', since the adhesive 22' is one with a strong adhesion for that purpose.

If a product labelled with the anti-theft label illustrated in FIG. 7 is stolen and carried through a gate-type detector having a transmitter and receiver coil, the label would essentially be irradiated by the transmitter coil with an alternating electromagnetic field which can cause the soft-magnetic sputter film 27' to be remagnetized at the frequency of the alternating field. This remagnetization can thereby cause the film 27' to emit an alternating electromagnetic field. If such a field is received by the receiver coil, the theft alarm can be set off. If the item is paid for, the nickel film 26', which has hard magnetic properties, can be magnetized by means of a strong magnet so that the nickel film 26' drives the soft magnetic sputter film 27' to magnetic saturation. Thus, the sputter film 27' can essentially no longer react to alternating electromagnetic fields as described above, i.e. the sputter film 27' is deactivated. The products with the deactivated anti-theft label can then essentially be carried through the detector without setting off an alarm.

Further, the present invention can generally relate to an item protected against theft and to a method of protecting an item against theft, which item can be protected against removal from a sales room or other commercial establishment where goods are typically sold by means of a security element. In addition, the item can be provided with a proof of authenticity attached to the security element.

Valuable items on display in sales showrooms have been protected against theft in the past by erecting a detector in the vicinity of the exit from the sales room, which detector interacts with a security element located in tags or labels which are fastened to the merchandise for sale. The security element interacts electromagnetically, e.g. by means of high frequency waves, or magnetically, when the security element comes closer than a specified distance to the detector. If a security element which has not been previously deactivated by a store employee, for example, after the item has been paid for, is carried past the detector, e.g. in an attempt to shoplift the item, the detector responds and emits an acoustical and/or optical alarm signal.

Valuable items are also increasingly being provided with proofs of authenticity, e.g. holograms, as proof of their authenticity, to make it easier for customers to recognize imitations and counterfeits. Any non-genuine products can frequently be disqualified or recognized on the basis of defective quality (e.g. cheap film packaged to look like well-known quality film). These products may also even be hazardous, such as counterfeit brake linings for motor vehicles. As such, there can be disadvantages for the buyer, as well as for the retailer, the wholesaler and the manufacturer.

In addition, customers who unknowingly purchased a counterfeit product, and are thus dissatisfied, frequently make claims against the retailer, the wholesaler or the manufacturer of the genuine products, since the customer thought the latter was the actual manufacturer. In court cases, or in a courtroom setting, it is frequently difficult for the manufacturer who has been sued to prove that it did not manufacture the products which are the subject of the complaint. Since such problems can essentially be eliminated by labelling the item with proofs of authenticity, an increasing number of items are being certified in this manner.

One disadvantage of conventional methods of protecting items against theft is that it is relatively easy to detect the security elements either visually or by touch, and to remove them from the item. A thief can thus relatively easily avoid activating the exit control and can therefore remove the merchandise essentially without being detected.

An object of the present invention is to create anti-theft protection for items, which anti-theft protection is characterized by increased security.

The present invention teaches that this object can preferably be achieved by non-detachably connecting the proof of authenticity to the security element.

The basic idea preferably is to connect the security element in an essentially non-removable manner with the proof of authenticity, whereby the latter should be very difficult to imitate or counterfeit. The resulting connection of these two elements to one another, designated "non-detachable" below, can essentially be permanent, at least to the extent that it is essentially impossible to remove the security element from the item without simultaneously removing the proof of authenticity. Preferably, the means of attachment can be selected so that the removal of the security element necessarily results in the destruction of the proof of authenticity.

In some cases, wherein the potential shoplifter is able to successfully remove the security element from the merchandise, when the security element is removed, the proof of authenticity will typically also always be removed, so that although the article can, of course, be removed from the sales room without activating the alarm system, the article will have lost a significant portion of its value due to the removal of the proof of authenticity. Thus, if the thief attempts to resell the stolen merchandise, a potential buyer will most likely be able to identify it as a lower-quality forgery, or possibly as a stolen item, and will refuse to buy it. Even if the item is intended only for the thief's personal use, third parties should be able to identify it as either a forgery or a stolen item. Consequently, there essentially will no longer be any reason to fear systematic, organized thefts of valuable merchandise, at the very least.

One primary advantage of the present invention is that a potential shoplifter typically will not remove the security element and the proof of authenticity from the merchandise, because the shoplifter will essentially not be able to resell the merchandise for as much money. Thus, the shoplifter will either leave the item in the store or be caught by the exit alarm system. It would typically also be more expensive and complicated to counterfeit the combination security element and proof of authenticity in accordance with the present invention than it would be to merely counterfeit the proof of authenticity, since a corresponding security element is required to make the item appear genuine. For the manufacturer, essentially all that is necessary is to apply a combined security and authentication element or proof of authenticity to the item. The advantages of the present invention can therefore go far beyond a separate identification including a proof of authenticity and a security element. That is, the advantages of the present invention can go far beyond the use of a separate proof of authenticity and a separate security element.

The proof of authenticity combined with the security element can be particularly advantageous for the owner of the store primarily due to the reduced rate of theft. In addition, there can be an additional benefit for the manufacturer due to the increased protection this combination can provide against counterfeiting of the merchandise. Reduced counterfeiting can be advantageous for all parties involved, i.e. the customer, the manufacturer, the wholesaler and the retailer, since the risk of problems which can result from the poor quality of counterfeit products, or the recourse which may be taken due to such counterfeit products, is typically reduced.

Items labelled and protected in accordance with the present invention will generally enjoy high acceptance among consumers, retailers and manufacturers, due to the advantages mentioned above, and will therefore enjoy a significant market advantage.

To prevent a potential thief from identifying the security element, the present invention teaches that the security element can preferably be attached to the surface of the proof of authenticity which faces the item. Since the security element can preferably be covered by the proof of authenticity, inexperienced persons will typically be unable to detect the presence of the security element, and will thus not remove it from the item when attempting to steal it, thereby setting off the alarm at the exit.

In accordance with the present invention, the type of proof of authenticity can be essentially anything which is appropriate. For example, the proof of authenticity can be a hologram, which holograms are well known in the art. In addition, also available commercially is a transparent material provided with cylindrical lenses on the surface running parallel to one another, whereby for each cylindrical lens there is at least one colored line running parallel to the axis of the cylindrical lens in the interior of the material. Such proofs of authenticity are characterized by a relatively high degree of protection against counterfeiting, and are also very economical. However, the particular advantage of the above-mentioned proofs of authenticity can be that it is relatively easy to determine visually whether the element has been tampered with because any attempt to first remove the security element and the proof of authenticity, and then secondly to re-attach the proof of authenticity after removing the security element, will alter the appearance of the article so significantly that the tampering will be readily apparent. It is therefore essentially impossible for the security element to be separated from the item in the sales showrooms, and then to have the item shoplifted with the proof of authenticity reattached.

There are also various possibilities regarding the type of security element which can be used in accordance with the present invention. As a first option, a narrow strip of magnetically soft material can preferably be used. The narrow strip of material can be energized in the exit alarm system by an alternating magnetic field, and can be remagnetized as a function of the respective frequency. Since the strip then itself preferably emits an alternating field which is detected by a receiving antenna, the anti-theft alarm is activated. For deactivation, the strip can also be covered by magnetically hard pieces of metal which are located at some distance from one another.

The present invention also teaches that a magnetically soft thin film coating deposited on a backing film, e.g. vacuum metallized or sputtered, can be used as the security element. For deactivation, there can be a magnetically hard metal film under and/or over it, e.g. a film of nickel.

Finally, as an alternative to the magnetic security devices, the invention recommends electromagnetic resonance circuits which can be realized as thin film integrated circuits. At the exit from the store, these circuits can preferably be energized with a high frequency field by a resonance circuit including a capacitor and an inductivity, so that if they resonate, they also emit waves which can be detected by means of suitable antennas to set off an alarm.

In accordance with one advantageous embodiment of the present invention, the security element can preferably be fastened on one side to the proof of authenticity and/or on the other side to the article by means of an adhesive connection. In particular, for the attachment of the proof of authenticity to the security element, a sufficiently strong connection should essentially be guaranteed by selecting a suitable adhesive.

For reasons of more efficient production, the present invention teaches that prefabricated security elements applied to a self-adhesive backing film can be used. Generally, the adhesive side of the backing film can come into contact with the article, while the proof of authenticity can preferably be fastened to the other, non-adhesive surface.

The proof of authenticity can also be provided on its side facing the article, i.e. on the side in contact with the security element, with a self-stick coating, to make it easier to assemble.

If the present invention is used to protect and prove the authenticity of a compact disc (CD), the security element and the proof of authenticity can preferably be applied in a ring-shaped manner around the central opening on the upper side of the CD, to prevent any imbalance which may interfere with playing the CD.

The present invention can also be used on other objects, in addition to compact discs. For example, the present invention can be used on packaging materials (e.g. for foods), on bottles, on electrical and electronic appliances, garden equipment, audio tape cassettes, video tape cassettes, diskettes, envelopes for diskettes, video or audio tapes, on office equipment, optical equipment, furniture, books or cosmetics, etc.

On bottles or food packaging, the proof of authenticity can, in addition to proving the authenticity of the item, also perform an additional function. If the proof of authenticity is applied to the opening of the package, for example as a tamper strip, it can be possible to see whether the seal has already been broken or the package opened or tampered with. A customer can then visually detect a package or bottle which has already been opened and can decide not to buy it.

Finally, it is also conceivable that textiles can be provided with a combination security element and proof of authenticity. The security element can be fastened, for example, between the proof of authenticity, which proof of authenticity is generally also made of textile material, for example in the form of an emblem or logo, and the item of clothing itself preferably by means of an adhesive connection. Alternatively, it is conceivable that the security element can be woven or sewn into the textile proof of authenticity. In either case, a potential shoplifter will either remove the proof of authenticity (which means that the article loses a great deal of its resale value), or be caught by the exit alarm.

One aspect of the invention resides broadly in a method of protecting an item against theft with an anti-theft apparatus, the item having a outwardly directed surface thereon, the anti-theft apparatus comprising: means for proving authenticity of the item, the means for proving authenticity having a first side and a second side; the first side of the means for proving authenticity being disposed to face the surface of the item; the second side of the means for proving authenticity facing away from the first side; means for being sensed, the means for being sensed being disposed between the first surface of the means for proving authenticity and the surface of the item; and means for non-detachably fastening the proof of authenticity to the means for being sensed such that the proof of authenticity can be removed from the means for being sensed substantially only upon destruction of the means for proving authenticity, the method comprising the steps of: providing means for proving authenticity of the item, the means for proving authenticity having a first side and a second side; the first side of the means for proving authenticity being disposed to face the surface of the item; the second side of the means for proving authenticity facing away from the first side; providing means for being sensed, the means for being sensed being disposed between the first surface of the means for proving authenticity and the surface of the item; and providing means for non-detachably fastening the proof of authenticity to the means for being sensed; the method further comprising the steps of: non-detachably fastening the proof of authenticity to the means for being sensed; and fastening the anti-theft apparatus to the item to be protected.

Another aspect of the invention resides broadly in an anti-theft apparatus for protecting an item against theft, the item having a outwardly directed surface thereon, the anti-theft apparatus comprising: means for proving authenticity of the item, the means for proving authenticity having a first side and a second side; the first side of the means for proving authenticity being disposed to face the surface of the item; the second side of the means for proving authenticity facing away from the first side; means for being sensed, the means for being sensed being disposed between the first surface of the means for proving authenticity and the surface of the item; and means for non-detachably fastening the proof of authenticity to the means for being sensed such that the proof of authenticity can be removed from the means for being sensed substantially only upon destruction of at least the means for proving authenticity.

One feature of the invention resides broadly in the item protected against theft, which is protected against removal from a sales room by means of an electromagnetic security element 4, and is provided with a proof of authenticity 2, characterized by the fact that the proof of authenticity 2 is non-detachably connected to the security element 4.

Another feature of the invention resides broadly in the item characterized by the fact that the security element is attached to the surface of the proof of authenticity facing the article 1, 7.

Yet another feature of the invention resides broadly in the item characterized by the fact that the proof of authenticity 2 is a hologram.

Still another feature of the invention resides broadly in the item characterized by the fact that the proof of authenticity 2 is a transparent material provided on the surface with cylindrical lenses running parallel to one another, whereby for each cylindrical lens there is at least one colored line in the interior of the material running parallel to the axis of the cylindrical lens.

A further feature of the invention resides broadly in the item characterized by the fact that the security element 4 is a magnetically soft metal strip.

Another feature of the invention resides broadly in the item characterized by the fact that the metal strip is covered by pieces of magnetically hard metal band or strip located at some distance from one another.

Yet another feature of the invention resides broadly in the item characterized by the fact that the security element 4 is a magnetically soft thin film deposited on a backing film.

Still another feature of the invention resides broadly in the item characterized by the fact that a magnetically hard metal film is located over and/or under the thin film.

A further feature of the invention resides broadly in the item characterized by the fact that the security element 4 is a resonant circuit.

Another feature of the invention resides broadly in the item characterized by the fact that the security element 4 is fixed by means of an adhesive connection to the proof of authenticity 2 and/or to the item 1, 7.

Yet another feature of the invention resides broadly in the item characterized by the fact that the security element 4 is positioned on a self-adhesive backing film 5, the adhesive side of which is preferably in contact with the item 1, 7.

Still another feature of the invention resides broadly in the item characterized by the fact that the surface of the proof of authenticity 2 facing the item 1, 7 is provided with a self-adhesive coating 3.

A further feature of the invention resides broadly in the item characterized by the fact that it is a compact disc 1, around the central opening 6 of which the proof of authenticity 2 and the security element 4 are placed in an encircling, ring-shaped manner.

In accordance with at least one embodiment of the present invention, FIGS. 1 and 1*a* can be considered to show a bottle incorporating the present invention to protect the bottle against shoplifting; FIGS. 2 and 2*a* can be considered to show a compact disc incorporating the present invention to protect the compact disc against shoplifting; FIG. 3 can be considered to show, in cross-section, an anti-theft tag having a metal strip as a security element; FIG. 4 can be considered to show a plan view, in partial cross-section, of the anti-theft tag of FIG. 3; FIGS. 5*a* and 5*b* can be considered to show simplified anti-theft tag structures; FIG. 6 can be considered to show, in cross-section, an anti-theft tag having the resonance circuit of FIGS. 8*a* and 8*b*; FIG. 7 can be considered to show an additional embodiment of an anti-theft tag; and FIGS. 8*a* and 8*b* show a plan view of an anti-theft tag having a resonance circuit as a security element.

Some of the types of adhesives and compositions thereof which could possibly be used for the adhesive layers in accordance with the present invention are listed herebelow:

- an elastomer-resin composition wherein the resin can be a hydrogenated ester and the elastomer can contain organic polyol and organic diisocyanate, as disclosed by U.S. Pat. No. 3,914,484 to Creegan and White, entitled "Pressure Sensitive Adhesive Labels and Method of Making"
- a polythioether polymer containing liquid polyene compositions cured to polythiol elastomeric products, as disclosed by U.S. Pat. No. 3,920,877 to Barber et al., entitled "Fully-Cured Crosslinkable Pressure Sensitive Adhesive Materials and Method of Making Same"
- a composition of acrylic acid ester or polyvinyl ether in combination with acrylic acid or a derivative of acrylic acid, a plasticizer and an emulsifier, as disclosed by U.S. Pat. No. 4,033,918 to Hauber, entitled "Water Removable Pressure Sensitive Adhesive"
- a thermoplastic block polymer in combination with a tackifying resin and a low saturated oil as disclosed by U.S. Pat. No. 4,097,434 to Coker, entitled "Adhesive Composition"
- an ABA-type monoalkenyl arene/conjugated diene block copolymer in combination with an AB two-block copolymer, a tackifying resin and a compounding oil, as disclosed by U.S. DEFPUB T00203 to Lauck, entitled "Label Adhesive"
- a polymer of vinyl or vinylidene monoaromatic monomer with conjugated diene unsaturated acid and an alkyl ester of methacrylic acid, as disclosed by U.S. Pat. No. 4,438,232 to Lee, entitled "Carboxylated Acrylate Styrene Butadiene Adhesives"
- an ester of acrylic acid with ethylenically unsaturated carboxylic acid; a conjugated diolefin with vinyl aromatic monomer and ethylenically unsaturated carboxylic acid; and monoolefin, vinyl ester and ethylenically unsaturated carboxylic acid, as disclosed by U.S. Pat. No. 4,540,739 to Midgley, entitled "Adhesive Polymer Latex"
- an acrylic copolymer component, such as an acetoacetyl group-containing acrylic copolymer, and a curing components such as an isocyanate or epoxy, as disclosed by U.S. Pat. No. 4,987,186 to Akiyama et al., entitled "Pressure Sensitive Adhesive Composition"
- a polymer of an acrylic ester of a saturated alcohol, with a surfactant and dextrin, as disclosed by U.S. Pat. No. 5,004,768 to Mahil and Cruden, entitled "Adhesive Composition and Self-Adhesive Sheet Material".

Some types of security elements/anti-theft labels made from magnetized, or magnetizable materials, which could possibly be utilized in accordance with the present invention, are disclosed by the following U.S. Patents: U.S. Pat. No. 4,799,045 to Fearon and Fearon, entitled "Method of Detecting a Label Used in an Anti-theft Surveillance System"; U.S. Pat. No. 4,652,863 to Hultman, entitled "Disarmable Magnetic Anti-Shoplifting Marker"; and U.S. Pat. No. 4,527,152 to Scarr and Fearon, entitled "Anti-Shoplifting System".

Some additional examples of antipilferage/anti-theft devices which may be utilized in accordance with the present invention may be disclosed in the following patents: U.S. Pat. No. 4,999,609 to Crossfield, entitled "Antipilferage Tags Having an Acoustic Resonator Chamber"; and U.S. Pat. No. 4,541,559 to O'Brien, entitled "Method of Making Electrical Connections Between Opposing Metal Foils Having a Flexible, Insulating Layer Sandwiched Therebetween."

Examples of various types of proofs of authenticity and methods of making same which may be utilized in accordance with the present invention may be disclosed in the following U.S. Patents: U.S. Pat. No. 5,083,199 to Börner, entitled "Autostereoscopic Viewing Device for Creating Three-Dimensional Perception of Images"; U.S. Pat. No. 5,303,370 to Brosh et al., entitled "Anti-counterfeiting Process Using Lenticular Optics and Color Masking"; U.S. Pat. No. 4,656,106 to Holland et al., entitled "Method of Preparing a Multicolored Holographic Image"; U.S. Pat. No. 4,707,054 to Howard et al., entitled "Apparatus and Method for Making a Reflection Hologram"; U.S. Pat. No. 6,662,653 to Greenaway, entitled "Optically Diffracting Security Element"; U.S. Pat. No. 5,200,253 to Yamaguchi et al., entitled "Hologram Forming Sheet and Process for Producing Same"; and U.S. Pat. No. 5,267,756 to Molee et al., entitled "Authentication System".

Examples of security elements, components associated therewith, and methods of making same which may be utilized in accordance with the present invention may be disclosed in the following U.S. Patents: U.S. Pat. No. 4,797,992 to Powers et al., entitled "Method of Making a Thin Film Integrated Microcircuit"; U.S. Pat. No. 4,759,823 to Asselanis et al., entitled "Method for Patterning PLZT Thin Films"; U.S. Pat. No. 4,740,762 to Powers et al. entitled "Thin Film Integrated Microcircuit"; and U.S. Pat. No. 5,276,430 to Granovsky, entitled "Method and Electromagnetic Security System for Detection of Protected Objects in a Surveillance Zone".

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The German patent application corresponding to the instant application U.S. patent application is No. P 44 10 137.6.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A tag for authenticating an item, the item having a outwardly directed surface thereon, said tag comprising:

means for proving authenticity of the item, said means for proving authenticity having a first side and a second side;

said first side of said means for proving authenticity being disposed to face the surface of the item;

said second side of said means for proving authenticity facing away from said first side;

means for being sensed, said means for being sensed being disposed between said first surface of said means for proving authenticity and the surface of the item; and means for non-detachably fastening said proof of authenticity to said means for being sensed such that said proof of authenticity can be removed from said means for being sensed substantially only upon destruction of at least said means for proving authenticity.

2. The tag according to claim 1, wherein said proof of authenticity comprises a hologram.

3. The tag according to claim 1, wherein said proof of authenticity comprises a transparent material provided on the surface with cylindrical lenses running parallel to one another, whereby for each cylindrical lens there is at least one colored line in the interior of the material running parallel to the axis of the cylindrical lens.

4. The tag according to claim 3, wherein said means for being sensed is fixed by an adhesive connection to said proof of authenticity and/or to the item.

5. The tag according to claim 4 wherein said means for being sensed is positioned on a self-adhesive backing film, the adhesive side of which is preferably in contact with the item.

6. The tag according to claim 5 wherein the surface of said proof of authenticity facing the item is provided with a self-adhesive coating.

7. The tag according to claim 4 wherein the item to be protected is a compact disc, around the central opening of which the proof of authenticity and the means for being sensed are placed in an encircling, ring-shaped manner.

8. A method of authenticating an item with a tag, the item having a outwardly directed surface thereon, said tag comprising: means for proving authenticity of the item, said means for proving authenticity having a first side and a second side; said first side of said means for proving authenticity being disposed to face the surface of the item; said second side of said means for proving authenticity facing away from said first side; means for being sensed, said means for being sensed being disposed between said first surface of said means for proving authenticity and the surface of the item; and means for non-detachably fastening said proof of authenticity to said means for being sensed such that said proof of authenticity can be removed from said means for being sensed substantially only upon destruction of said means for proving authenticity, said method comprising the steps of:

providing means for proving authenticity of the item, said means for proving authenticity having a first side and a second side;

said first side of said means for proving authenticity being disposed to face the surface of the item;

said second side of said means for proving authenticity facing away from said first side;

providing means for being sensed, said means for being sensed being disposed between said first surface of said means for proving authenticity and the surface of the item; and providing means for non-detachably fastening said proof of authenticity to said means for being sensed;

said method further comprising the steps of:

non-detachably fastening said proof of authenticity to said means for being sensed; and fastening said tag to the item to be authenticated.

9. A tag for authenticating and protecting an item, the item having a outwardly directed surface thereon, said tag comprising:

means for indicating authenticity of the item;

said means for indicating authenticity comprising a proof of authenticity, said proof of authenticity having a first side and a second side;

said first side of said proof of authenticity being disposed to face the surface of the item;

said second side of said proof of authenticity facing away from said first side;

means for being sensed by a security system;

said means for being sensed being disposed between said first side of said proof of authenticity and the surface of the item; and means for fixedly fastening said proof of authenticity to said means for being sensed such that said proof of authenticity can be removed from said means for being sensed substantially only upon destruction of at least said proof of authenticity.

10. The tag according to claim 9 wherein said proof of authenticity comprises one of:

a hologram; and a transparent material having a surface, said surface of said transparent material comprising a plurality of cylindrical lenses each having an axis and extending parallel to one another, said transparent material further comprising at least one colored line corresponding to each of said cylindrical lenses, said at least one colored line extending parallel to the axis of its corresponding said cylindrical lens.

11. The tag according to claim 10 wherein:

said means for being sensed comprises a security element having a first side and a second side facing away from one another;

said first side of said security element being fixedly fastened to said first side of said proof of authenticity; and said second side of said security element being fixedly fastened to the surface of the item to be protected.

12. The tag according to claim 11 further comprising:

a first adhesive and a second adhesive;

said first side of said security element being fixedly fastened to said first side of said proof of authenticity by said first adhesive; and said second side of said security element being fixedly fastened to the surface of the item by said second adhesive.

13. The tag according to claim 12 wherein:

said proof of authenticity comprises means for essentially covering said security element and for essentially preventing detection of said security element by a potential thief;

said proof of authenticity being visually interpretable by a viewer of the item and identifying the origin of the item;

said security system comprises one of: an electromagnetic security system and a magnetic security system; and said tag comprises an anti-theft tag for protecting an item against theft.

14. The tag according to claim 13 wherein said means for being sensed comprises one of a) and b):

a) a magnetically soft metal strip; and a plurality of magnetically hard metal bands disposed in spaced-apart intervals from one another and covering said magnetically soft metal strip; and b) a backing film;

a magnetically soft thin film deposited on said backing film; and a magnetically hard metal film disposed on said magnetically soft thin film.

15. The tag according to claim 13 wherein said means for being sensed comprises a resonant circuit.

16. The tag according to claim 13 wherein the item to be authenticated comprises a compact disc having a central opening, the central opening being circular, and further wherein:

said proof of authenticity and said security element both comprise a ring-like shape, said proof of authenticity and said security element both being disposed about the central opening of the compact disc.

17. The tag according to claim 13 wherein the item to be authenticated comprises a consumable product such as a bottle, the bottle having an exterior surface, and further wherein:

said proof of authenticity and said security element are both disposed on the exterior surface of the product.

18. A combination method of making a tag and authenticating and protecting an item with said tag, the item having a outwardly directed surface thereon, said method of making said tag comprising the steps of:

providing means for indicating authenticity of the item;

said step of providing said means for indicating authenticity of the item further comprising providing a proof of authenticity having a first side and a second side facing away from one another;

disposing said first side of said proof of authenticity to face the surface of the item;

providing means for being sensed by a security system;

disposing said means for being sensed between said first side of said means for proving authenticity and the surface of the item; and providing means for fixedly fastening said proof of authenticity to said means for being sensed;

fixedly fastening said first side of said proof of authenticity to said means for being sensed, with said means for fixedly fastening, such that said proof of authenticity can be removed from said means for being sensed substantially only upon destruction of at least said proof of authenticity; and said method of authenticating and protecting comprising:

fixedly fastening said tag to the item to be authenticated and protected.

19. The method according to claim 18 wherein said step of providing said proof of authenticity comprises providing one of:

a hologram; and a transparent material having a surface, said surface of said transparent material comprising a plurality of cylindrical lenses each having an axis and extending parallel to one another, said transparent material further comprising at least one colored line corresponding to each of said cylindrical lenses, said at least one colored line extending parallel to the axis of its corresponding said cylindrical lens.

20. The method according to claim 19 further comprising:

providing said proof of authenticity with means for essentially covering said security element and for essentially preventing detection of said security element by a potential thief;

essentially covering said security element and essentially preventing detection of said security element by a potential thief, with said means for essentially covering;

said step of providing said means for being sensed comprises providing a security element having a first side and a second side facing away from one another, said security element comprising means for being detected by one of: an electromagnetic security system and a magnetic security system;

providing a first adhesive and a second adhesive;

fixedly fastening said first side of said security element to said first side of said proof of authenticity with said first adhesive;

fixedly fastening said second side of said security element to the surface of the item to be protected with said second adhesive;

said step of providing said means for being sensed comprises providing one of a), b) and c):

a) a magnetically soft metal strip; and a plurality of magnetically hard metal bands disposed in spaced-apart intervals from one another and covering said magnetically soft metal strip;

b) a backing film;

a magnetically soft thin film deposited on said backing film; and a magnetically hard metal film disposed on said magnetically soft thin film; and c) a resonant circuit;

said step of providing said proof of authenticity comprises providing a proof of authenticity visually interpretable by a viewer of the item and identifying the origin of the item.

* * * * *